US005862694A

United States Patent [19]

Horning

[11] Patent Number: 5,862,694

[45] Date of Patent: Jan. 26, 1999

[54] TAPERED TUBE MANUFACTURING APPARATUS AND PROCESS

[75] Inventor: Vincent R. Horning, Wooster, Ohio

[73] Assignee: Union Metal Corporation, Canton, Ohio

[21] Appl. No.: 914,538

[22] Filed: Aug. 19, 1997

[51] Int. Cl.[6] ..... B21D 39/02; B21D 5/08; B21C 37/06

[52] U.S. Cl. ..... 72/52; 72/181; 72/368

[58] Field of Search ..... 72/51, 52, 178, 72/182, 179, 181, 208, 209, 234, 237, 367.1, 368; 228/17.5, 17, 151, 166, 146

[56] References Cited

U.S. PATENT DOCUMENTS

| | | | |
|---|---|---|---|
| 3,361,319 | 1/1968 | Sato et al. | 228/7 |
| 3,648,008 | 3/1972 | Kawato et al. | 72/198 |
| 4,006,617 | 2/1977 | Foster | 72/181 |
| 4,122,696 | 10/1978 | Midzutani et al. | 72/52 |
| 4,299,108 | 11/1981 | Kato et al. | 72/178 |
| 4,568,015 | 2/1986 | Toyooka et al. | 228/147 |
| 4,697,446 | 10/1987 | Yamamoto et al. | 72/178 |
| 4,971,239 | 11/1990 | Tyler et al. | 228/146 |
| 5,016,459 | 5/1991 | Kuramoto | 72/178 |
| 5,090,227 | 2/1992 | Takeda et al. | 72/178 |
| 5,657,922 | 8/1997 | Lowery et al. | 72/368 |

*Primary Examiner*—Joseph J. Hail, III
*Assistant Examiner*—Rodney Butler
*Attorney, Agent, or Firm*—Sand & Sebolt

[57] ABSTRACT

An improved forming station and process for use in tapered tube manufacturing apparatus and process where fully synchronized output motion of multiple slave axes on adjustable rolls are scaled to the external process input of the master axis so as to generate continuously moving output process position synchronized to the asynchronous process input.

17 Claims, 9 Drawing Sheets

TAPERED TUBE MANUFACTURING APPARATUS AND PROCESS

BACKGROUND OF THE INVENTION

1. Technical Field

The present invention relates generally to an apparatus and process for making hollow tapered tubes. More particularly, the present invention is an apparatus and process which identifies, achieves, and maintains position control during the roll forming process. Specifically, the present invention is an apparatus and process which uses feedback systems to control roll positioning cylinders at different ratios of displacement thereby best accommodating machinery geometry and various shaft taper rates.

2. Background Information

Metal tapered tubes have been used for decades in numerous pole applications including for supporting lamps as used for illuminating highways, roads, streets, developments, parking lots, and other public areas. These metal tapered tubes have been particularly adopted for use on all major highways and roadways and most particularly in city or urban areas as illuminated roadways and public areas such as parking lots are much safer than non-illuminated ones. These tapered tubes have also been used in other applications including as cable poles, electrical wire poles, flag poles, etc. and are therefore very popular with urban planners, civil engineers, architects, city engineers, etc.

These metal tapered tubes are further very popular for various reasons. First, these metal tubes have a pleasant appearance due to the metallic properties, tapered shape, and general long life. Second, these metal tubes are of a very high strength due to the high strength of metal and the tapered shape. Third, these metal tubes are light weight due to the hollow nature combined with the physical properties of metal which include high strength without large mass or thickness.

In the past, the tubes were often not tapered and instead were manufactured as a cylinder due to the ease of such manufacturing processes. However, the tapered design offers so many advantages including improved strength that it is the overwhelming choice in numerous tube uses including illuminated light poles.

In the past, metal tapered tubes have been produced or formed from a metal plate that has been cut in advance. The metal plate is generally cut in a regular trapezoidal shape or a shape also referred to as a section of a frustrum of a right circular cone, that is the two ends are parallel although one is longer than the other, while the two sides are the same length but angled toward each other.

This metal plate is passed through a peripheral curved surface formed by a group of rollers arranged on the same periphery to press the metal plate with many contact points or surfaces. The resiliency of the metal plate is utilized to force the metal by forming into a different shape, in this case from a flat body into a curved body that is preferably curved in a circular cross sectional manner. All of this occurs by advancing the plate through the group of rollers while simultaneously withdrawing said group of rollers in a continuous radial and proportional manner. After this process, the product is finished by welding and finishing the joints.

One example of such prior art practice is found in U.S. Pat. No. 3,361,319 issued to Masao Sato et al. As is shown in FIGS. 4*a* and 4*c*, the six rollers are continuously withdrawn as the cut plate is pushed through thereby forming a tapered tube. In this and other prior art arrangements, the system is always physically geared, linked or cammed to position the working rolls during the process where in each scenario the position of the working rolls is always determined by fixed mechanics and the motion of the machinery. For instance, in the '319 patent, the position of the rollers is determined and controlled by a rotatable cam plate. In effect, the withdrawing motion of the rollers from a central axis is identical for each roller and is a fixed equation, specifically, a fixed linear equation based upon the motion of the machinery as physically connected to the withdrawing apparatus on each roller.

As each piece of metal is not uniform, and the forming of each flat metal plate into a curved and circular cross sectioned tube is never uniform, the process of withdrawing each cylinder uniformly along the length of the tube being formed and uniformly as each roller withdraws by the same radial distance is a quite imperfect process. Often the metal plate twists, bends, contorts, etc. as it is formed. The current processes have no way of addressing this nonuniform forming. As a result, a need exists for monitoring and/or identifying current locations and status of the metal plate and rollers during the process, and then achieving and maintaining proper corrections in each roller withdraw rate and location, all of which must remain independent of the other rollers withdraw rate and location although correlated to assure that the cumulation of all of the rollers withdraw rate and location is maximized to achieve the optimal forming and thus most uniform formed tapered tube or pole shaft.

In addition, current forming processes merely run the flat metal plate through one former resulting in a substantially tapered tube with a pair of spaced apart edges that need welded together. The resiliency of the metal is such that the forming step cannot in one pass form a flat metal into a circular cross section and instead provides a C-shaped element in which the spaced apart edges must be forced together during welding. This forcing is negative. Furthermore, due to the current inaccurate forming as described above, the edges are not always parallel, are often too far apart, are often not in the same plane, are often twisted over the length of the tube, etc. whereby welding is either ineffective or less than optimal.

For these and other reasons that are known to those skilled in the art, a new and improved apparatus and process is needed to manufacture metal tapered tubes for pole shafts such as those for use in illuminating streets, roads, parking lots, highways, and other applications.

SUMMARY OF THE INVENTION

Objectives of the invention include providing an improved apparatus and process of manufacturing metal tapered tubes.

A further objective is to provide a metal tapered tube manufacturing apparatus and process which addresses varying machine geometry.

A further objective is to provide a metal tapered tube manufacturing apparatus and process which addresses varying geometry in the cut metal piece from which the tapered tube is made.

A further objective is to provide a metal tapered tube manufacturing apparatus and process which addresses varying geometry in the formed tube during forming from the cut metal piece.

A further objective is to provide a metal tapered tube manufacturing apparatus and process which does not position the working rolls using fixed mechanics.

A further objective is to provide a metal tapered tube manufacturing apparatus and process which does not position the working rolls solely or at all using motion of the machinery.

A further objective is to provide a metal tapered tube manufacturing apparatus and process which identifies either or both roller position and tube position.

A further objective is to provide a metal tapered tube manufacturing apparatus and process which identifies individual roller position.

A further objective is to provide a metal tapered tube manufacturing apparatus and process which corrects, achieves, or otherwise maintains proper or optimal roller position control.

A further objective is to provide a metal tapered tube manufacturing apparatus and process which overcomes the spring back or springing open forces in the formed tube thereby removing theses stresses from the tube at or after welding and thus reducing failure of the welds.

A further objective is to provide an improved apparatus and process which accomplishes more than one or all of the above listed objectives, as well as other objectives including those obvious to one of skill in the art.

These and other objectives and advantages of the invention are obtained by the improved forming station for use in a tapered tube manufacturing apparatus and process. The improved forming station including a frame, a master roll rotatably fixed to said frame, a plurality of actuators fixed to the frame, a plurality of radially adjustable rolls all within the same plane and perpendicular to a forming axis that passes between all of the adjustable rolls and the master roll thereby defining a moving process path, each of the radially adjustable rolls being rotatably fixed to one of the actuators which provides the radial adjustment in relation to the frame and forming axis, and a controller for independently controlling the radial actuation of each actuator so as to optimally position each radially adjustable roll to form the most optimal shaped tapered tube.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
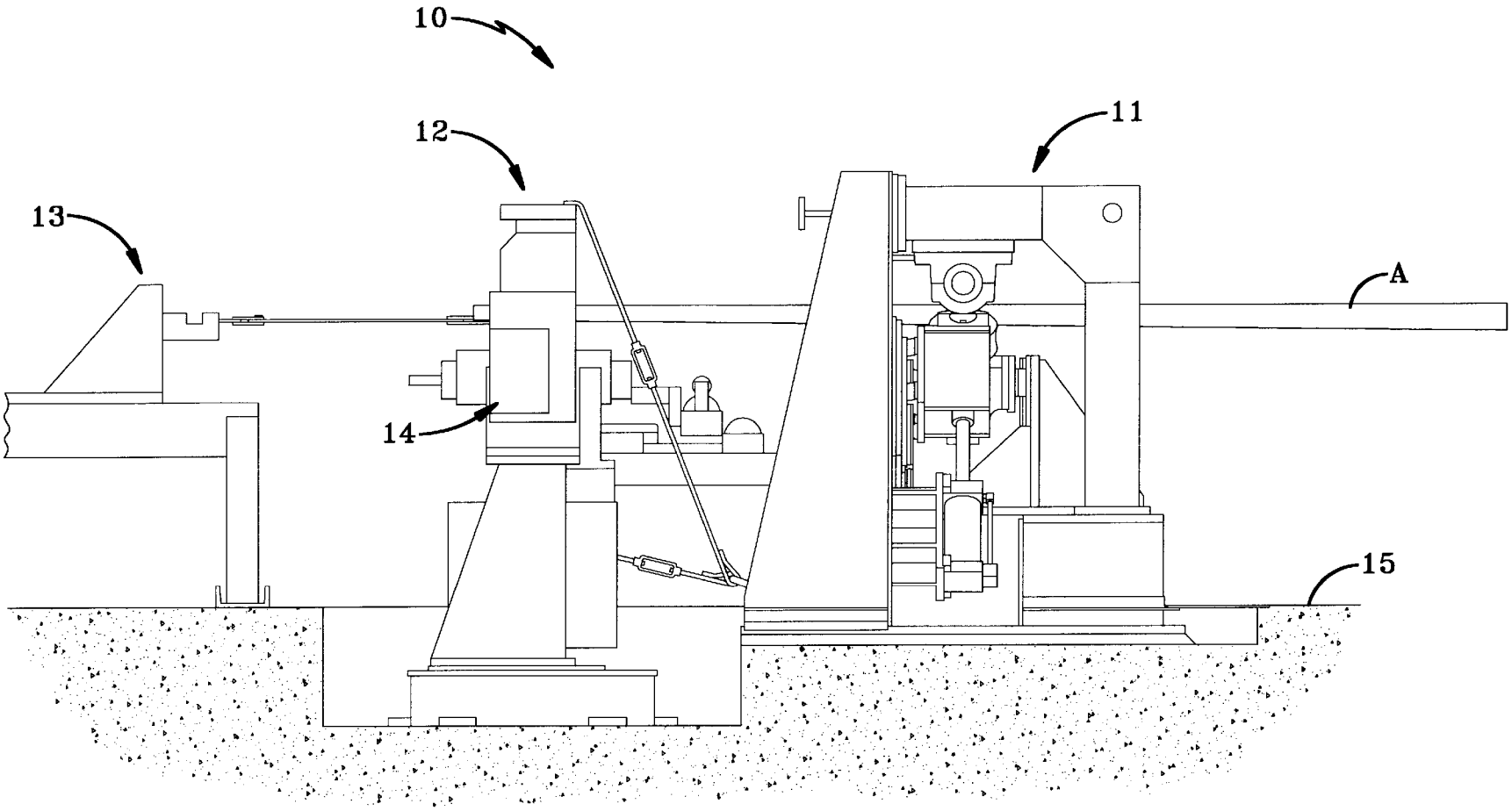
FIG. 1 is a side elevational view of the improved tapered tube manufacturing apparatus.
Figure 2:
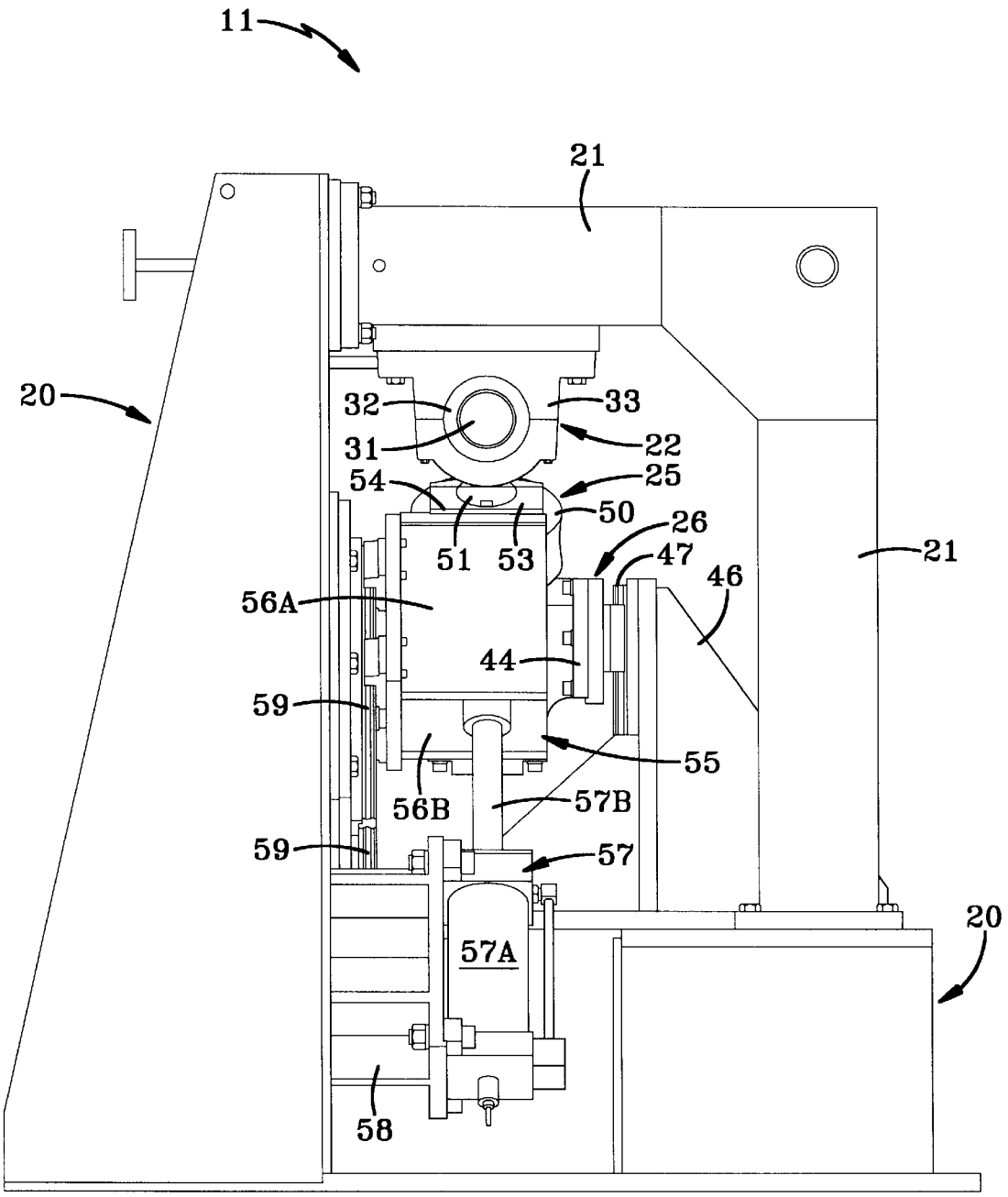
FIG. 2 is an enlarged view of a portion of the improved tapered tube manufacturing apparatus of FIG. 1.
Figure 3:
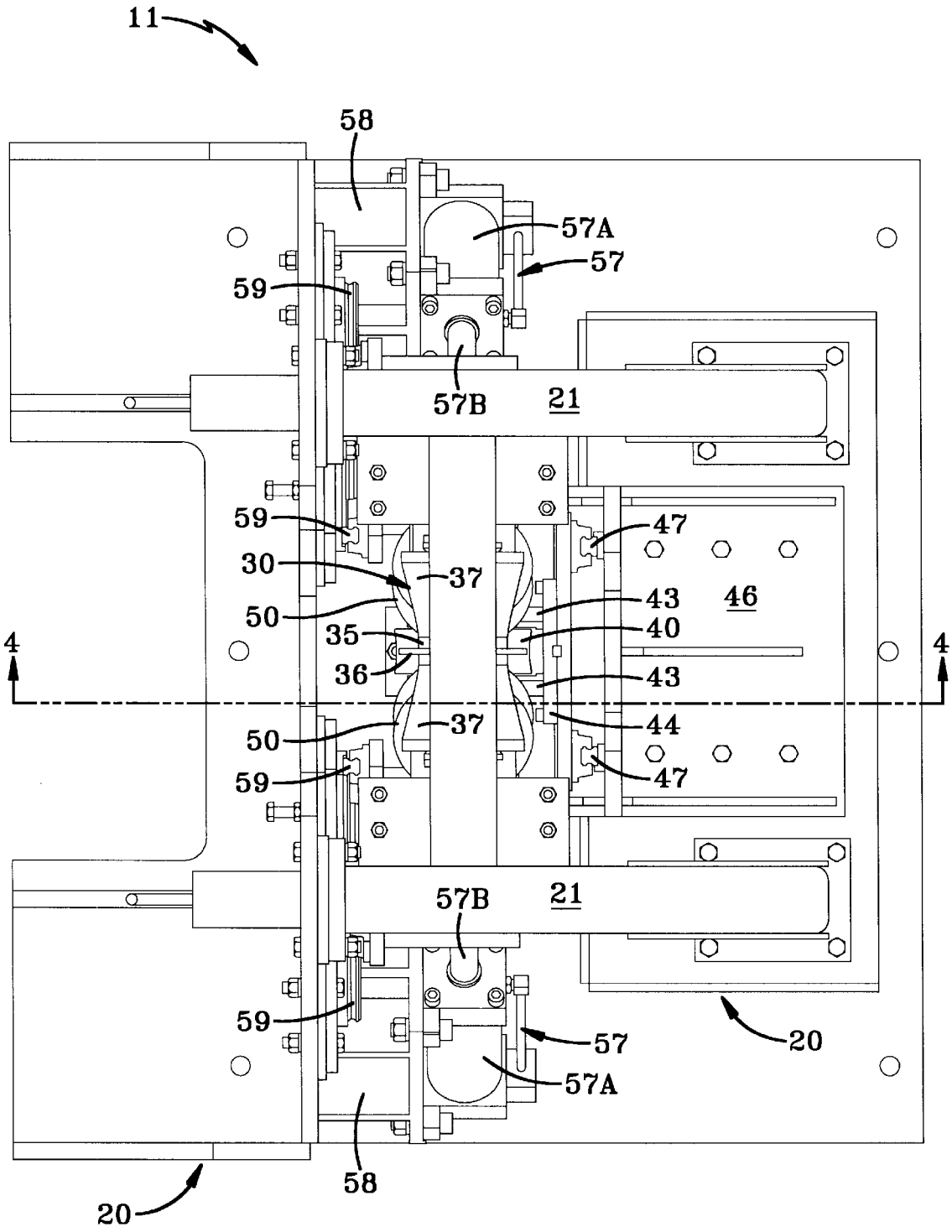
FIG. 3 is a top plan view of the improved tapered tube manufacturing apparatus of FIG. 1.

The improved tapered tube manufacturing apparatus is shown in FIG. 1 and generally indicated as 10. The apparatus 10 includes a forming station 11, a welding and finishing station 12, a pulling station 13, and a controller 14, all of which is affixed to a base 15 which is often the floor or other rigid structure. The apparatus 10 takes a flat pre-cut piece of metal generally in the shape of a trapezoid and forms it into a tapered tube having a circular cross section. As shown, these three stations are the secondary forming portion of the tapered tube manufacturing process.

In general, the entire process is as follows. Large coils of metal are unrolled and flattened as is well known in the art. These flattened rolls are then cut to length as is well known in the art. A bias slitter is then used to cut the rectangular piece of metal into a trapezoidal piece as is also well known in the art. An initial forming station or step rolls or folds the trapezoid into a conical "C" shape. In accordance with one of the features of the invention, a secondary former then further forms the conical "C" shaped tube into a closed or substantially closed "O" shaped tube whereby spring back that is common in metal due to its properties is overcome by the stepped forming. After the completion of forming, a seam welder welds the adjacent longitudinal edges together to form a closed "O". The closed and welded "O" is then a completed round and tapered tubular shaft. In some cases, the completed round and tapered tubular shaft is then processed through a rolling machine where cold working transforms the "O" into the desired shape (square, octagonal, fluted, etc.) or works the "O" into a perfectly circular cross section.

In accordance with one of the main features of the invention, at least one of or both of the primary and secondary formers as described in the previous paragraph incorporate the improved technology of forming station 11. Forming station 11 includes a plurality of rollers electronically coupled to a position feedback servo control for causing mechanical adjustment and control of the rollers during axial movement of a tube-being-formed through the station. The feedback control and mechanical adjustment and control providing fully synchronized output motion of the rollers along the multiple slave axes scaled to the external process inputs of the master axis.

Figure 5:
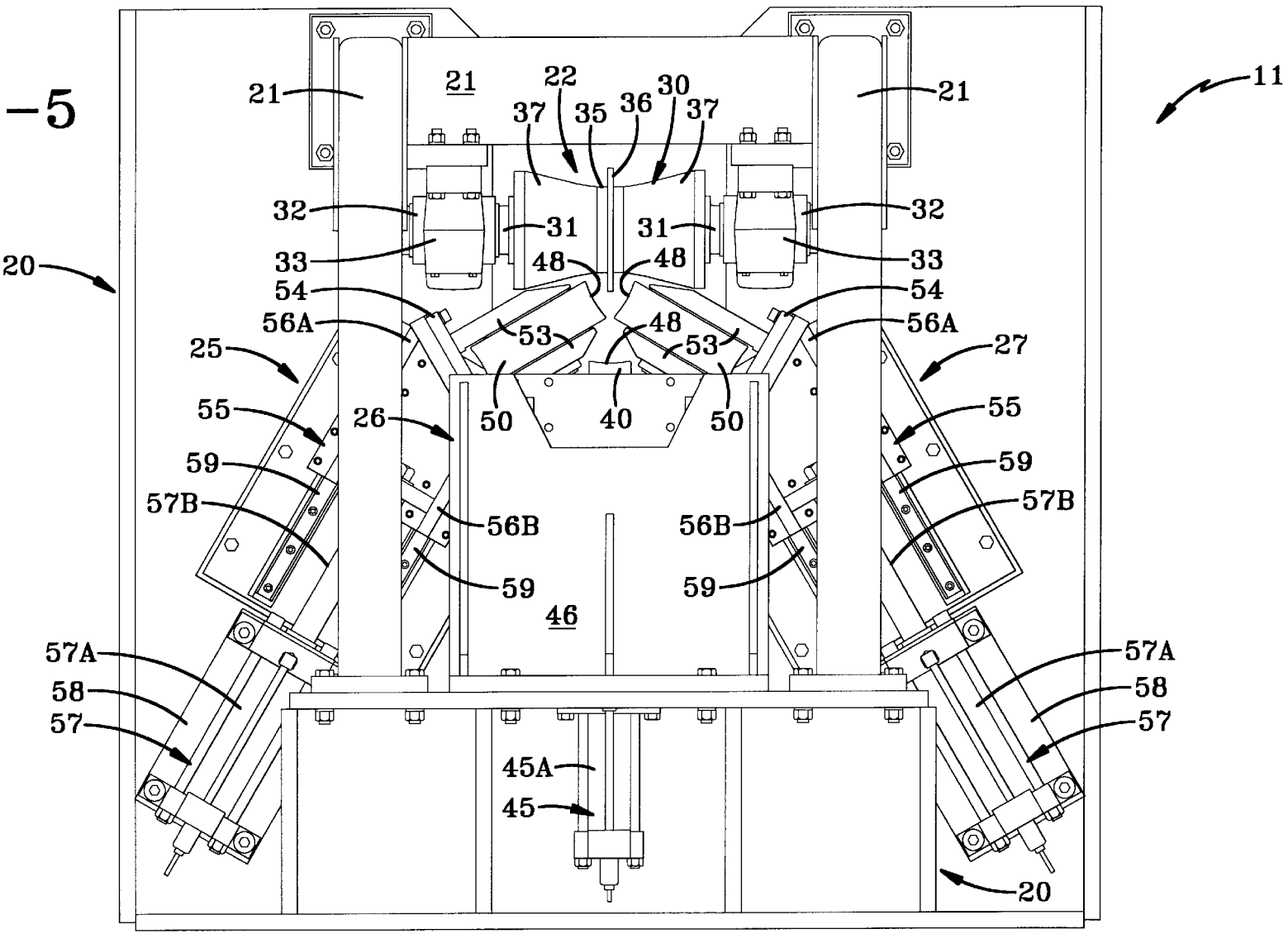
FIG. 5 is an end elevational view of the improved tapered tube manufacturing apparatus of FIG. 1 in a closed (constricted) position.
Figure 6:
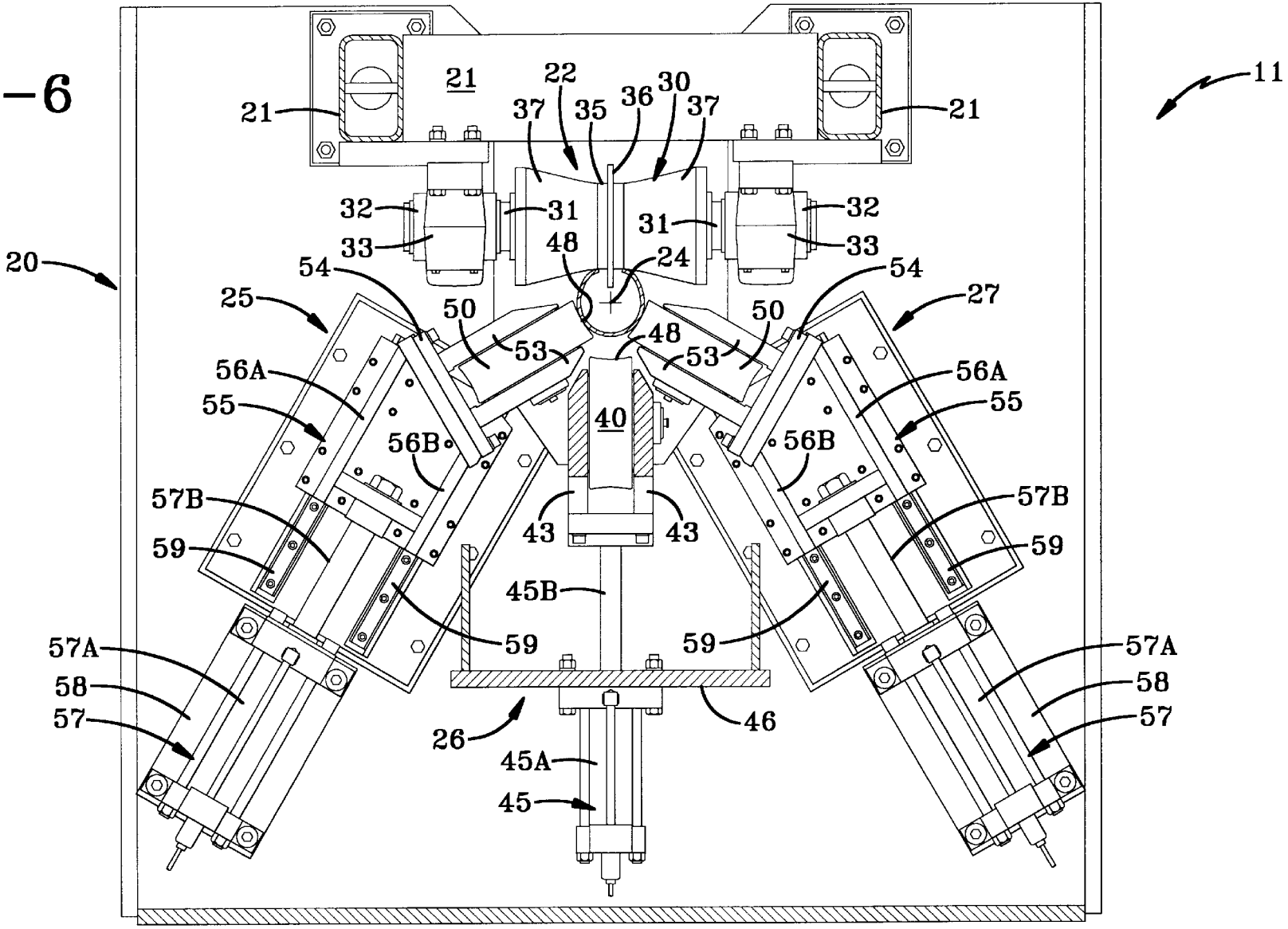
FIG. 6 is the same end elevational view as FIG. 5 except the rollers are partially withdrawn.
Figure 7:
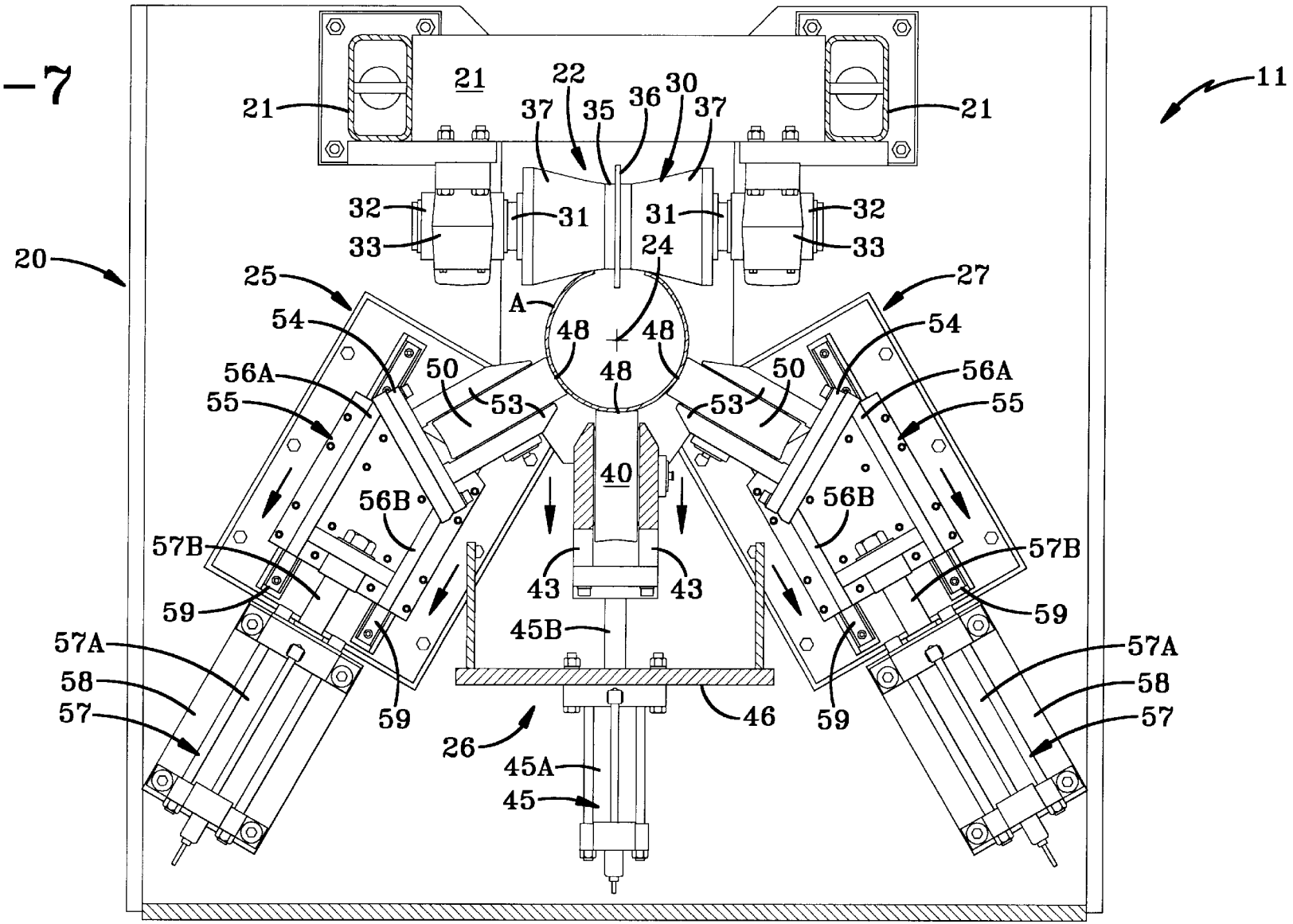
FIG. 7 is the same end elevational view as FIG. 5 except the rollers are open (fully or significantly withdrawn)
Figure 8:
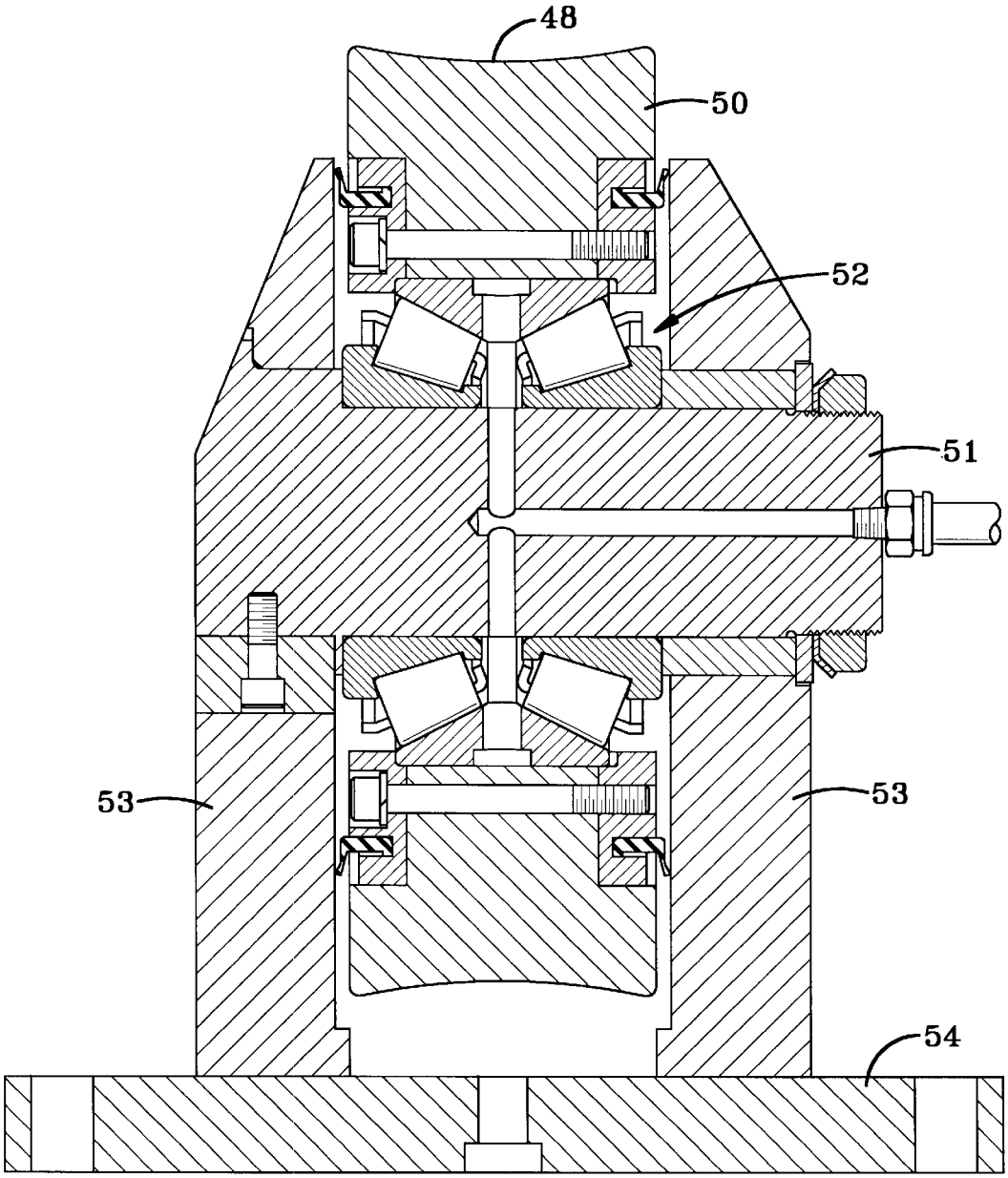
FIG. 8 is a sectional view of one of the forming rolls of the improved tapered tube manufacturing apparatus of FIGS. 1–7.

As best shown in FIGS. 5–7, specifically, forming station 11 includes a frame or base assembly 20 with an overhead support 21, a top fin roll assembly or master roll assembly 22 affixed to and hanging from the support 21, and a plurality of forming rolls surrounding a tube formation axis 24 below the top fin roll, the plurality of forming rolls being three rolls in the most preferred embodiment, namely a first forming roll assembly 25, a second forming roll assembly 26, and a third forming roll assembly 27.

The top fin roll assembly 22 is fixed to the support 21. The assembly 22 includes a top fin roll 30 with a shaft 31 extending from each end, a bearing assembly 32 attached to the shaft extending from each end and providing for rotation of the shaft and roll as needed, and bearing housings 33 enveloping each bearing which are attached to the support 21 while being fixed from rotating but allowing for bearing assembly 32 rotation therein.

Figure 4:
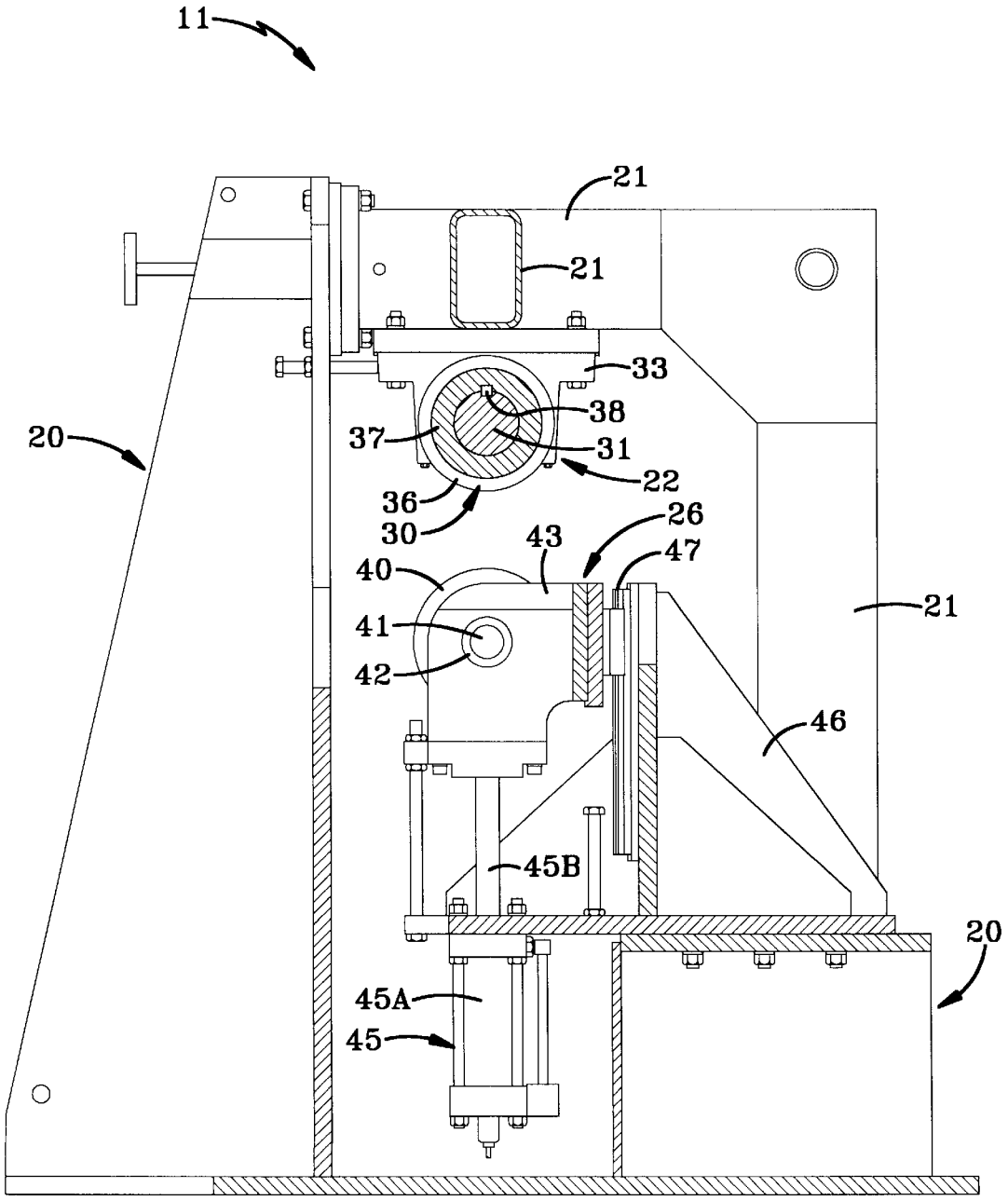
FIG. 4 is an enlarged sectional view of the improved tapered tube manufacturing apparatus taken along line 4—4 in FIG. 3.

Top fin roll 30 is assembled around the shaft 31. Specifically, top fin roll 30 includes a center piece 35 with an annular centering lip 36, and at least one conical shaped piece 37 on each side thereof. A key 38, as shown in section in FIG. 4, prohibits angular movement of the pieces 35 and 36.

The first forming roll assembly 25, second forming roll assembly 26, and third forming roll assembly 27 are all of substantially identical construction absent the angling of the assemblies 25 and 27. As to the second forming roll assembly 26, as is best shown in FIGS. 4–7, the assembly includes a bottom forming roll 40, a shaft 41 extending out from each end of the roll, a bearing assembly 42 within the shaft for allowing rotation of the shaft-roll assembly, roll housings 43 enveloping the bearings and being fixed from rotating but allowing for bearing rotation therein, a mounting plate 44 on which both roll housings are mounted, an actuator 45 (including a chamber 45A and a drive rod 45B) for selectively providing linear motion to the mounting plate 44 and roll 40 attached thereto so as to assure proper contact and positioning of the roll during the forming process, a roll frame 46 rigidly affixed to the housing base 15 and on which the actuator is mounted, and a slide track 47 (best shown in FIG. 4) for guiding actuation.

Various sensors, encoders, and other feedback devices are also present to monitor position, placement, angle, speed, movement and many other critical elements which are necessary to provide the controller with exact positioning of the rolls, tube-being-formed, etc. These sensors are critical in that they allow each of the roll assemblies 25–27 to be separately moved, adjusted, actuated, etc. so as to assure proper tube formation due to proper roll location and movement throughout the entire process.

The roll 40 is basically a cylinder where the annular wall is the contact surface 48. This contact surface 48 is concave as is best shown in FIGS. 5–7 so as to best provide a surface conducive to cylindrical or tapered tube formation.

The first and third roll forming assemblies 25 and 27 are similar in construction to the second roll forming assembly except for the angled adjustable positioning of the first and third assemblies as described below. In addition, assemblies 25 and 27 are identical to each other except for opposing tilts and thus only assembly 25 will be discussed in detail as the entire discussion is applicable to the assembly 27 and thereby incorporated thereto. The assembly 25 includes a forming roll 50, a shaft 51 extending out from each end of the roll, a bearing assembly 52 within the shaft for allowing rotation of the shaft-roll assembly, roll housings 53 enveloping the bearings and being fixed from rotating but allowing for bearing rotation therein, a mounting plate 54 on which both bearing housings are mounted, an angled frame 55 with a pair of support plates 56A and 56B, a roll positioning actuator 57 (including a chamber 57A and a drive rod 57B) for selectively providing linear motion to the mounting plate 54 and roll 50 attached thereto so as to assure proper contact and positioning of the roll during the forming process, an actuator frame 58 rigidly affixed to the housing 15 and on which the actuator is mounted, and a slide track 59 for guiding actuation. The support plate 56A is longer than 56B thereby providing angle to the mounting plate 54 and roll 50 with reference to the actuator 57 and frame 58.

As with the second roll forming assemblies, the first and third assemblies also include various sensors, encoders, and other feedback devices to monitor position, placement, angle, speed, movement and many other critical elements which are necessary to provide the controller with exact positioning of the rolls, tube-being-formed, etc. Once again, these sensors are critical in that they allow each of the roll assemblies 25–27 to be separately moved, adjusted, actuated, etc. so as to assure proper tube formation due to proper roll location and movement throughout the entire process.

The roll 50 is also basically a cylinder where the annular wall is the contact surface 48. This contact surface 48 is concave as is best shown in FIGS. 5–7 so as to best provide a surface conducive to cylindrical or tapered tube formation as described above for the bottom roll 40 also.

Each of the three actuators 45 and 57 are independent of one another and are separately actuated and move at different rates as dictated by the controller. This allows the tapered tube to be optimally formed as each roll is optimally positioned throughout the process as the overall diameter of the tube-being-formed changes.

The controller 14 and its system of sensors, encoders, and other feedback devices is generally a position feedback servo control which produces fully synchronized output motion of the multiple slave axes scaled to the external process input of the master axis. The slave axes are electronically geared for various ratios of output motion to generate continuously moving output process position synchronized to the asynchronous process input.

More specifically, a motion control system 60 (FIG. 9) synchronizes the position of forming rolls 25–27 via the positioning cylinders or actuators 45 and 57. This synchronization is at moving process diameter of the tube-being-formed A. In effect, each cylinder and roll position is mathematically determined as a function of process length along the tapered shaft where the roll positioning actuators 45 and 57 move at different ratios of displacement to accommodate machinery geometry, various shaft taper rates, and any other system or tube variables. The controller controls the moving of the forming rolls 25–27 and the cylinders that actuate them in a synchronized manner to hold the moving process diameter of the tube-being formed A in response to the asynchronous movement of the tube-being-formed through the machine. All of this is measured by sensors and encoders connected to the top fin roll and other locations if necessary.

Figure 9:
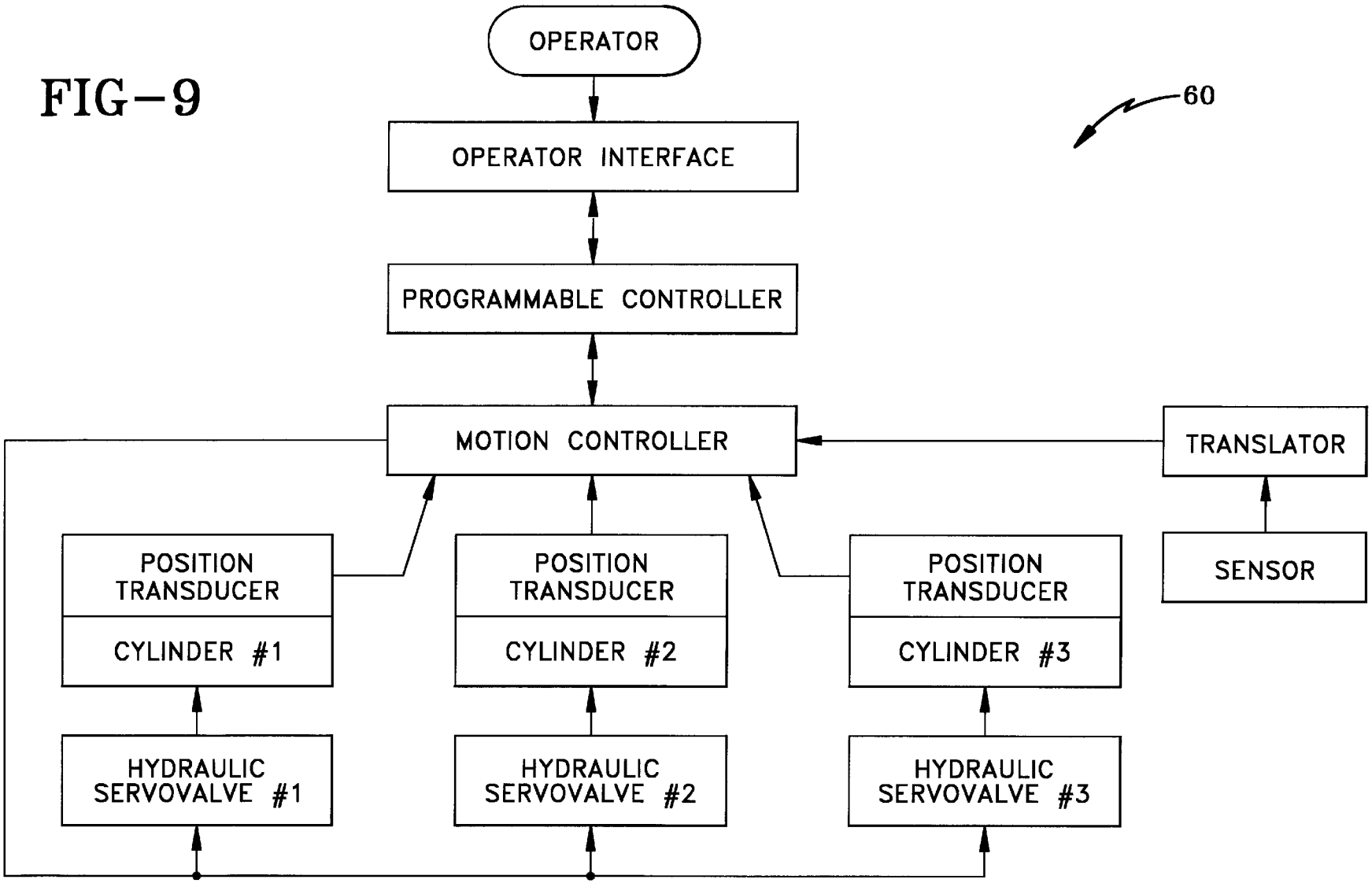
FIG. 9 is a block diagram of the overall control system.

The control system is generally shown in FIG. 9 in flow chart or block diagram format. As is shown, the operator initially inputs various parameters including desired taper rate and tube size. Basically, this is an initialization stop where tube position and process parameters are inputted. The operator interface is connected to a programmable controller which is adjustable according to any operator inputs, or alternatively may be programmed to monitor via the sensors and encoders and thereafter react thereto to correct roll 25–27 positioning, displacement, speed, etc. The programmable controller is connected to a motion controller which supplies the needed motion, signal, energy, etc. to the actuators or cylinders 45 and 57 as needed to properly synchronize moving process diameter of the tube-being-formed.

The motion controller is independently connected to hydraulic servovalves attached to each actuator 45 and 57 on each roll assembly 25–27. An output signal is sent by the motion controller to the servovalves as needed. The hydraulic servovalve provides the needed pressurized fluid to actuate the cylinders as needed to continuously maintain the desired taper rate and tube size as initially inputted and calculated to assure as much uniformity as possible between the inputs and net result. These cylinders are shown in FIG. 9 as cylinders #1, #2, and #3 which refer to actuators 45, 57, and 57 on roll assemblies 25–27. Each cylinder or actuator also includes a position transducer for providing feedback to the controller so as to assure proper actuation at the proper speed, displacement, etc. which is sent back to the motion controller as a position feedback signal. These signals allow the controller to maintain constant verification of the process and to allow constant and independent adjustment to assure the inputted parameters are met.

A motion translator also exists which translates rotary motion along the fin roll into linear tube travel so that the controller can always know the tube position. Basically, the sensor is along the main or master axis which is the axis of the fin roll. Three other axes exist, all of which are the slave axes. One slave axes exists on each of the three forming rolls. As indicated above these slave axes are controlled by the controller such that each is independently electronically geared to generate a continuously moving tube-being-formed that is optimally shaped due to the synchronization of all of the asynchronous inputs including tube shape and roll positions.

In sum, the position of each forming roll during the process is mechanically independent of the other rolls but synchronized with the other rolls such that the asynchronous inputs are controlled so as to produce an optimally shaped and formed tapered tube. The roll assemblies are also controlled in a manner such that when the small diameter end is being formed as shown in FIG. 5 and often the occurrence at the beginning of the process, the bottom roll assembly 26 is not activated as the curvature and diameter of the tube is not sufficient to support all three assemblies. Once a certain diameter is reached, for example 8 inches in one embodiment, the bottom roll assembly 26 is actuated into contact with the tube-being-formed and synchronized into the process as is shown in FIG. 7 (note: the arrows show the movement of the actuators, but understand that the arrows are each independently displacing at different rates as needed to synchronize the system). During the entire process, the annular centering lip serves to keep the gap in the tube-being-formed along the top fin roll even during uneven radial stresses as applied by the forming rolls. Overall, the result is three slave rolls independently controlled by one master roll.

Accordingly, the improved tapered tube manufacturing apparatus and process is improved, simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the tapered tube manufacturing apparatus and process is constructed and used, the characteristics of the construction, and the advantageous, new and useful results obtained; the new and useful structures, devices, elements, arrangements, parts and combinations, are set forth in the appended claims.

We claim:

1. A forming station in a tapered tube manufacturing apparatus adapted to work a substantially "C"-shaped tapered tubular structure into a substantially "O"-shaped tapered tubular structure, the forming station comprising:

a frame;

a master roll assembly including a master roll rotatably fixed to said frame;

a plurality of roll form actuators fixed to the frame;

a plurality of radially adjustable roll assemblies, each roll assembly having a radially adjustable forming roll, each of the forming rolls being perpendicular to a forming axis that passes between all of the adjustable forming rolls and the master roll thereby defining a moving process path, each of the radially adjustable forming rolls being rotatably fixed to one of the roll form actuators that provides the radial adjustment in relation to the frame and forming axis;

measuring means for measuring the length of the tapered tubular structure that moves past the master roll assembly and creating a measurement signal; and a controller system in communication with the measuring means that independently controls the radial actuation of each roll form actuator in response to the measurement signal to continuously move the forming rolls to accommodate the changing diameter of the tapered tubular structure as the tapered tubular structure moves past the master roll while maintaining contact between the tapered tubular structure and the master roll causing the substantially "C"-shaped tapered tubular structure to be formed into a substantially "O"-shaped tapered tubular structure.

2. The forming station of claim 1 wherein the master roll is a top fin roll.

3. The forming station of claim 1 wherein each of the plurality of radially adjustable forming rolls includes an exterior surface of a concave configuration.

4. The forming station of claim 1 further comprising a position feedback servo control connected to each roll form actuator.

5. The forming station of claim 1 wherein the measuring means includes a rotary motion sensor in conjunction with the master roll.

6. The forming station of claim 2 wherein the fin roll includes an annular centering lip.

7. The forming station of claim 4 wherein the controller system includes a motion controller for signaling one or more of the position feedback servo controls to continuously reposition the respective actuator to the roll position corresponding to process size.

8. The forming station of claim 7 wherein the controller system further includes a programmable controller to accept input on process variables specific to the tapered tube being processed, to monitor the progress of the tapered tube being processed, to monitor the progress of the tapered tube trough the process, to continually calculate and update the roll form actuator position corresponding to the process size, and to generate command signals to the motion controller for synchronizing the motion of the actuators in relation to one another and the master roll.

9. The forming station of claim 8 wherein the controller system further includes a position transducer associated with each actuator for monitoring position.

10. The forming station of claim 5 further comprising a motion translator for translating the rotary motion sensed by the rotary motion sensor into a linear tube travel signal.

11. A method for forming a tapered tube comprising the steps of:

preparing coiled steel for formation into tapered tubing by transforming the coiled steel into substantially trapezoidal pieces ready for forming, each trapezoidal piece having first and second edges that are converging;

working the trapezoidal piece into a tapered tubular structure having a substantially "C"-shaped cross section wherein the first and second edges are substantially parallel and spaced apart by a first distance;

working the tapered tubular structure having the substantially "C"shaped cross section into a tapered tubular structure having a substantially "O"shaped cross section wherein the first and second edges remain substantially parallel and are spaced apart by a second distance with the second distance being less than the first distance; and welding the first and second edges together.

12. The method of claim 11 wherein the step of working the tapered tubular structure includes the steps of:

moving the tapered tubular structure through a master roll and at least two forming rolls, the master roll and forming rolls being disposed in substantially the same plane;

contacting the first and second edges of the substantially "C"-shaped cross section with the master roll;

holding the first and second edges of the substantially "C"-shaped cross section against the master roll with the forming rolls as the tapered tubular structure moves through the rolls so that the "C"-shaped cross section is changed to a substantially "O"-shaped cross section;

measuring the length of the tapered tubular structure that moves past the master roll; and continuously adjusting the positions of the forming rolls automatically in response to the length measurement to provide uniform forming along the length of the tapered tubular structure.

13. The method of claim 12 wherein the step of continuously adjusting the positions of the forming rolls includes the steps of inputting the initial desired diameter and taper rate of the tapered tubular section into a controller; and creating output signals from the controller in response to the length measurement that independently actuate a roll position actuator for each forming roll to position the forming roll in the desired position in response to the length measurement.

14. The method of claim 12 wherein the step of moving the tapered tubular structure through a master roll and at least two forming rolls includes the step of:

moving the tapered tubular structure through a third forming roll, the third forming roll disposed in substantially the same reference plane as the master roll; and continuously positioning the third forming roll in response to the length measurement.

15. The method of claim 12 wherein the step of measuring the length includes the step of measuring the rotation of the master roll and transforming the rotational measurement to a length measurement.

16. A method for working a tapered tubular structure having a substantially "C"-shaped cross section with first and second edges, the method comprising the steps of:

moving the tapered tubular structure through a master roll and at least two forming rolls, the master roll and forming rolls being disposed in substantially the same reference plane, the reference plane being substantially perpendicular to the longitudinal axis of the tapered tubular structure;

contacting the first and second edges of the substantially "C"-shaped cross section with the master roll;

holding the first and second edges of the substantially "C"-shaped cross section against the master roll with the forming rolls as the tapered tubular structure moves through the rolls so that the "C"-shaped cross section is changed to a substantially "O"-shaped cross section;

measuring the length of the tapered tubular structure that moves past the master roll; and continuously adjusting the positions of the forming rolls automatically in response to the length measurement while the tapered tubular structure is moving through the master roll and at least two forming rolls to provide uniform forming along the length of the tapered tubular structure.

17. The method of claim 16 further including the step of:

moving the tapered tubular structure through a third forming roll, the third forming roll disposed in substantially the same reference plane as the master roll; and continuously positioning the third forming roll in response to the length measurement.

* * * * *